US006834519B1

(12) United States Patent
Yang

(10) Patent No.: US 6,834,519 B1
(45) Date of Patent: Dec. 28, 2004

(54) PADLOCK HAVING RECEIVING CHAMBER INSIDE

(76) Inventor: Yao-Kun Yang, No. 101, Lane 93, Chang Lu Road, Chang Hua City (TW)

( * ) Notice: Subject to any disclaimer, the term of this patent is extended or adjusted under 35 U.S.C. 154(b) by 0 days.

(21) Appl. No.: 10/757,544

(22) Filed: Jan. 15, 2004

(51) Int. Cl.[7] ..... E05B 65/48; E05B 69/00
(52) U.S. Cl. ..... 70/58; 70/63; 70/25; 70/312
(58) Field of Search ..... 70/58, 63, 24, 70/25, 54–56, 312, 314, 315, 318

(56) References Cited

U.S. PATENT DOCUMENTS 2,163,852 A * 6/1939 Pond ..... 70/21
3,419,893 A * 12/1968 Vahlstrom ..... 70/24
3,436,937 A * 4/1969 Barrett ..... 70/63
3,750,431 A * 8/1973 Atkinson ..... 70/21
3,766,758 A * 10/1973 Heine et al. ..... 70/25
3,837,189 A * 9/1974 Atkinson ..... 70/21
3,979,932 A * 9/1976 Piche ..... 70/63
3,983,724 A * 10/1976 Foote ..... 70/25
4,047,406 A * 9/1977 Foote ..... 70/25
4,325,240 A * 4/1982 Gable ..... 70/284
4,341,099 A * 7/1982 Garro ..... 70/25
4,476,698 A * 10/1984 Treslo ..... 70/25
4,532,783 A * 8/1985 Maurice ..... 70/63
4,641,505 A * 2/1987 Maurice ..... 70/63
4,649,723 A * 3/1987 Appelbaum ..... 70/63
4,838,052 A * 6/1989 Williams et al. ..... 70/63
4,869,082 A * 9/1989 Appelbaum ..... 70/63
5,046,339 A * 9/1991 Krell ..... 70/55
5,090,222 A * 2/1992 Imran ..... 70/63
5,134,869 A * 8/1992 Gable ..... 70/63
5,280,518 A * 1/1994 Danler et al. ..... 379/102.06
5,737,947 A * 4/1998 Ling ..... 70/63

* cited by examiner

*Primary Examiner*—Suzanne Dino Barrett
(74) *Attorney, Agent, or Firm*—Browdy and Neimark, P.L.L.C.

(57) ABSTRACT

A padlock having a receiving chamber inside includes a base housing, a shackle set, a numbered wheel set, and a cover housing. It is characterized in that the base housing further includes a base shell extending outwards from a side thereof. A cover shell is pivotably closeably mounted to a side of the base shell for being freely opened and closed. A locking member is disposed for locking the cover shell. The receiving chamber is formed between the cover shell and the base shell. Accordingly, the numbered wheel set can be driven to move to further control the cover shell and the shackle set to be locked/unlocked, thereby bringing the convenience of using the receiving chamber.

11 Claims, 6 Drawing Sheets

PADLOCK HAVING RECEIVING CHAMBER INSIDE

BACKGROUND OF THE INVENTION

1. Field of the Invention

The present invention relates generally to locks, and more particularly, to a padlock having a receiving chamber inside.

2. Description of the Related Art

There are many kinds of locks having various structures and designs, generally including key locks and combination locks; the former needs keys to unlock the locks, and the latter needs the combination to unlock the locks. For families, the door locks generally belong to key locks, such that the users have to carry the keys with themselves while going out of the houses. However, once the users carelessly forget to carry the keys with themselves or lose the keys while going out of the houses, they will fail to enter the houses without the keys. Hence, most of the users will duplicate the keys and hide the duplicate keys at a secret place outside the doors for the backup purpose, but the thieves may probably find such way to enter the houses, thereby causing huge loss for the users. It is indeed a problem for most of the users in daily life.

Further, when the parents go out of the houses, their children forget to carry the keys with themselves, and nobody is in the houses, the children may probably stay outside alone to put themselves in jeopardy. In addition, when the parents intend to inform their children of something important before they go outdoors, if they leave the notepapers of such important messages at a random place, the children may unawarely ignore such notepapers to cause unavailability of the important messages for the children.

SUMMARY OF THE INVENTION

The primary objective of the present invention is to provide a padlock having a receiving chamber inside; the padlock as a combination lock can be securely locked on objects, like general cylindrical locks of handles, rails, etc., and can be controlled by the combination to lock/unlock the padlock and to close/unclose the receiving chamber.

The secondary objective of the present invention is to provide a padlock having a receiving chamber inside; the receiving chamber is adapted for easily placing and retrieving keys, notepapers, and other items inside, and the padlock is structurally strengthened.

The foregoing objectives of the present invention are attained by the padlock, which is composed of a base housing, a shackle set, a numbered wheel set, and a cover housing. The base housing defines a compartment recessed inwards. The shackle set is mounted on said base housing and having a shackle bar and at least one fastening piece for locking the shackle bar. The numbered wheel set is disposed in said compartment and has a fastening sheet moveable between a first position such that the fastening sheet engages the fastening piece for enabling said fastening piece to firmly lock the shackle bar and a second position such that the fastening sheet disengages the fastening piece for enabling the fastening piece to detachably lock the shackle bar, and a plurality of numbered wheels for driving the fastening sheet to move to one of the first and second positions. The cover housing is mounted on the base housing and over the compartment, which has a plurality of slots through which the numbered wheels are exposed. A base shell extends from a side of the base housing. A concavoconvex cover shell is pivotably closeably connected with the base shell to form a receiving chamber between the cover shell and the base shell for storing things. A locking member is mounted in the compartment of the base housing for locking the cover shell. The locking member locks the cover shell firmly when the fastening sheet is moved to the first position and the locking member locks the cover shell detachably when the fastening sheet is moved to the second position.

DETAILED DESCRIPTION OF THE INVENTION

Figure 1:
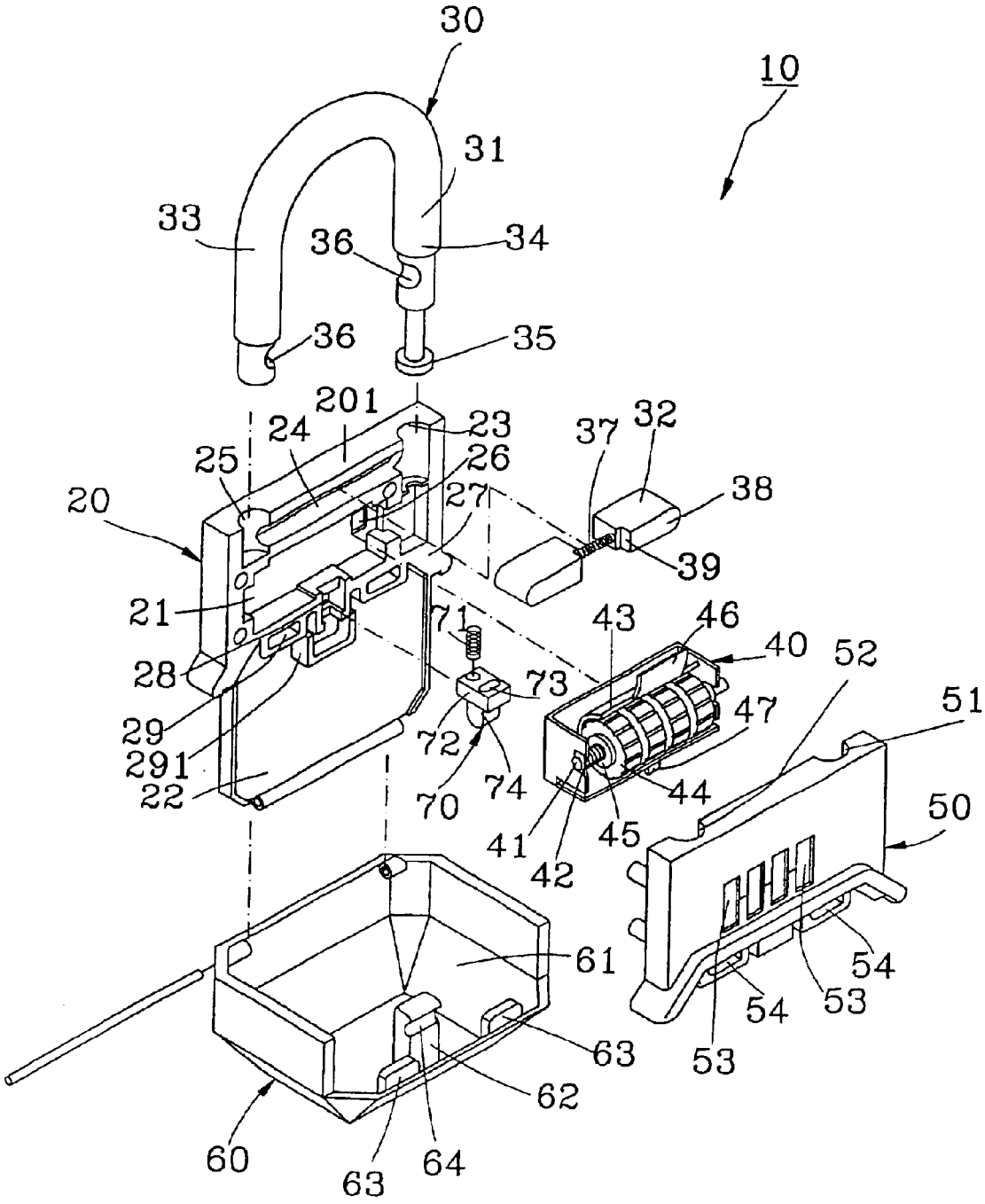
FIG. 1 is an exploded view of a padlock of the present invention.
Figure 2:
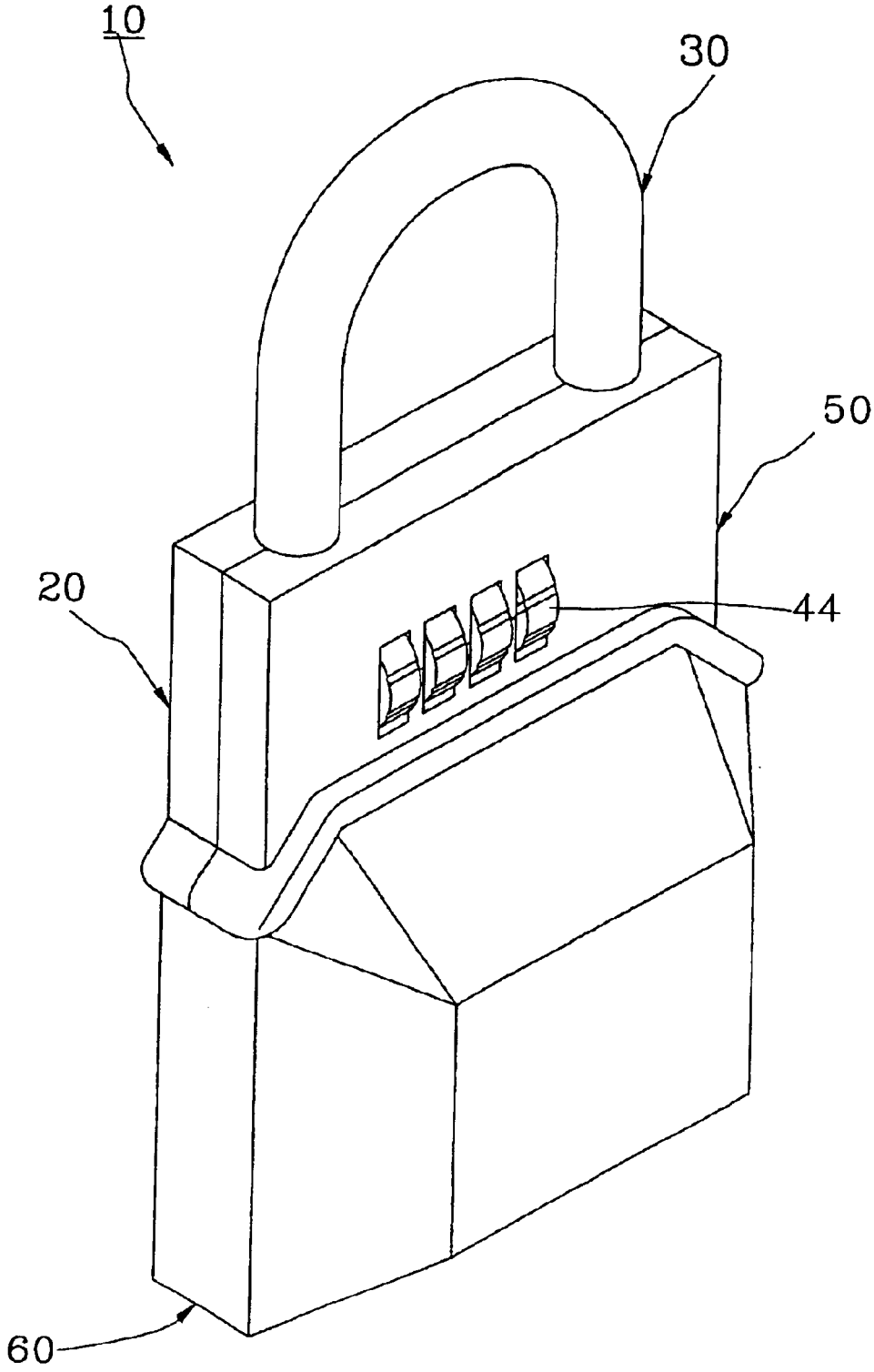
FIG. 2 is a perspective view of the padlock of the present invention.

Referring to FIGS. 1–5, a padlock 10 constructed according to the present invention comprises a base housing 20, a shackle set 30, a numbered wheel set 40, a cover housing 50, a cover shell 60, and a locking member 70.

The base housing 20 is a flat square member and includes a compartment 21 recessed inwards and a tabular base shell 22 extending downwards therefrom. The base housing 20 includes a semi-cylindrical pivoting portion 23, an elongated groove 24, and a semi-cylindrical pit 25 respectively formed at an inner surface thereof abutting a top surface 201 thereof; simulated long axles of the pit 25 and the pivoting portion 23 both are perpendicular to the top surface 201, and the elongated groove 24 has a longitudinal axle parallel to the top surface 201 and communicates with the pivoting portion 23 and the pit 25. In addition, the base housing 20 includes a combination hole 26 at a bottom of the compartment 21, a partition 27 extending under the compartment 21, a recess 28 formed on the partition 27, two positioning holes 29 formed on the partition 27, and a U-shaped guarding rib 291 disposed under the recess 28.

The shackle set 30 includes a shackle bar 31 and two fastening pieces 32. The shackle bar 31 has a curved hook portion 33 and a straight rod portion 34. The rod portion 34 is pivotably connected to the pivoting portion 23 to freely rotate and traverse to further enable a bottom end of the hook portion 33 to be inserted into the pit 25 of the base housing 20. The rod portion 34 further has a bottom section and a retaining portion 35 formed at a bottom end thereof and having a larger diameter than the bottom section for restraining the range of traversing of the shackle bar 31. Each of the hook portion 33 and the rod portion 34 has a recessed portion 36 formed at an inner side thereof and facing the other. The two fastening pieces 32 are disposed respectively at two ends of the elongated grooves 24 and are connected with a spring 37 therebetween. Each of the two fastening pieces 32 has a stepped portion 39 formed at an inner side thereof and an arched fastening end 38 positioned at a distal end thereof for engaging the recessed portion 36 of the shackle bar 31 to secure the shackle bar 31.

Figure 4:
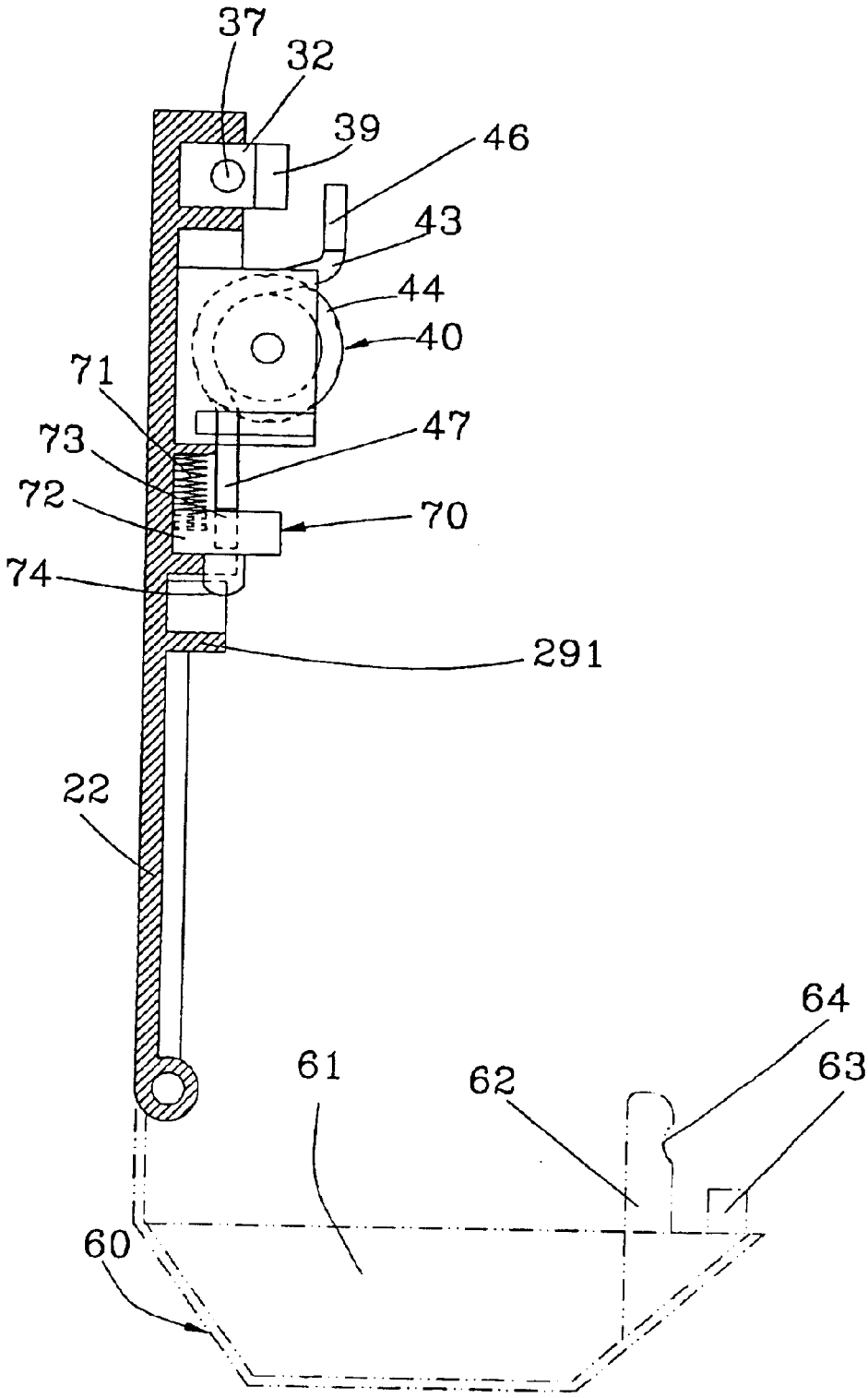
FIG. 4 is a sectional view taken from a line 4—4 indicated in FIG. 3, showing that the movable fastening sheet is moved to the second position.
Figure 5:
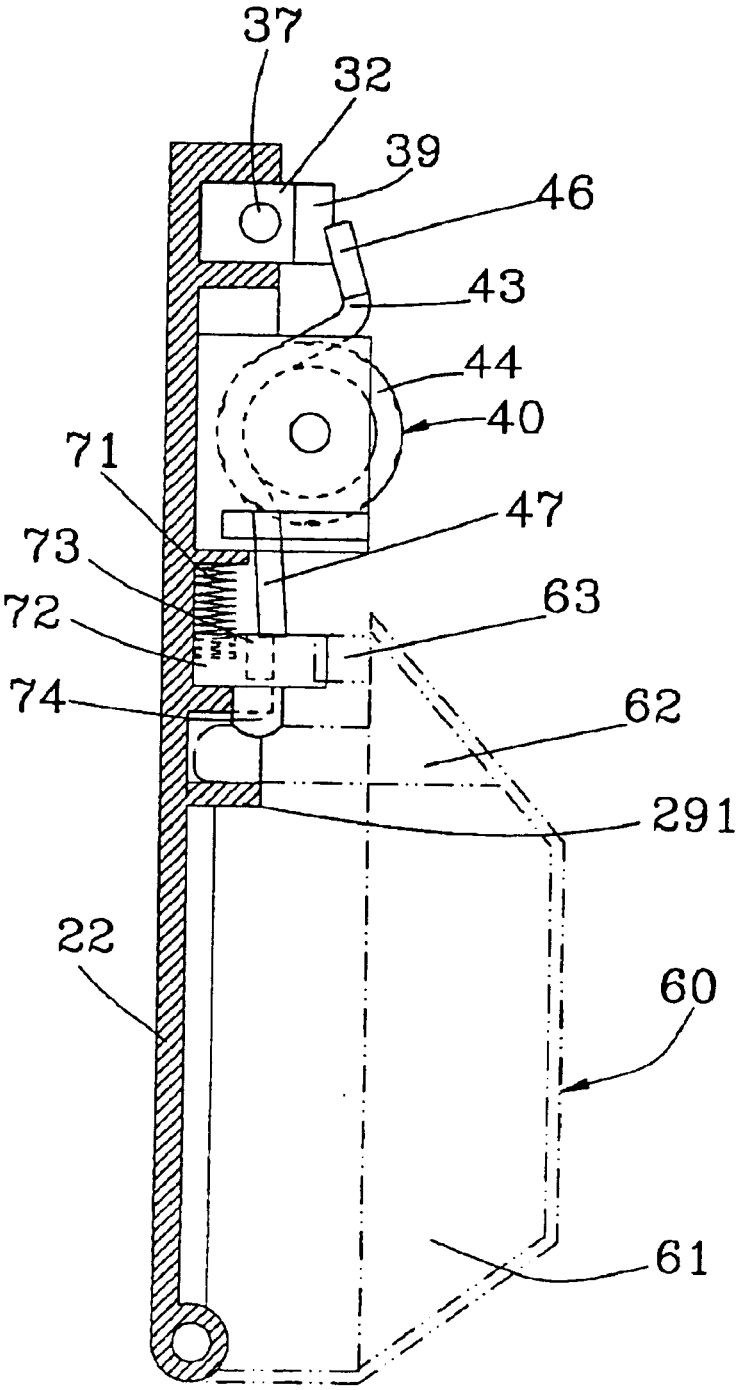
FIG. 5 is similar to FIG. 4 but showing that the movable fastening sheet is moved to the first position.

The numbered wheel set 40 is disposed inside the compartment 21 of the base housing 20 and includes a rotary shaft 41, a spring 42, a movable fastening sheet 43, four numbered wheels 44, a driving wheel 45, and a combination control rod (not shown) extending out of the combination hole 26. The movable fastening sheet 43 can be driven to move to a first position as shown in FIG. 5 or a second position as shown in FIG. 4 by turning the numbered wheels 44 to further lock/unlock the padlock 10. Because the numbered wheel set 40 is well known to one person having ordinary skill in the art, no more description is necessary. However, it is to be noted that the movable fastening sheet 43 has an upper fastening portion 46 and a lower fastening portion 47 formed respectively at an upper edge and a lower edge thereof.

The cover housing 50 is mounted on the base housing 20 and includes an inner surface in corresponding position with that of the base housing 20. The cover housing 50 includes a pivoting portion 51 and a pit 52 both formed at the inner surface thereof and having the same shape with the pivoting portion 23 and the pit 25 of the base housing 20 for accommodating the base housing 20 to receive the shackle bar 30, four square slots 53 formed thereon for the numbered wheels 44 exposed outside to facilitate turning the numbered wheels 44, and two through holes 54 corresponding to the two positioning holes 29.

The cover shell 60 includes a peripheral edge in complementary shape with an outer edge of the base shell 22 and a lateral edge pivotably connected to a bottom lateral edge of the base shell 22, thereby defining a receiving chamber 61 between the base shell 22 and the cover shell 60. The cover shell 60 can be freely turned about the bottom lateral edge of the base shell 22 to close/unclose the receiving chamber 61. The cover shell 60 further includes a wedge column 62 and two positioning blocks 63 all extending outwards from an inner side thereof. The two positioning blocks 63 can be inserted into the through holes 54 and the positioning holes 29 to structurally strengthen the cover shell 60 while the cover shell 60 is turned to close the receiving chamber 61. The wedge column 62 has a concave portion 64 formed thereon.

The locking member 70 is disposed in the recess 28 of the base housing 20 and includes a spring 71, a block 72, a cavity 73, and a lug 74. The spring 71 engages against the recess 28 and a top end of the block 72 at two ends thereof. The cavity 73 is formed on a top side of the block 72 for inserting therein the lower fastening portion 47 of the movable fastening sheet 43. The lug 74 extends outwards from a bottom side of the locking member 70 and is provided with an arched front end for engaging the concave portion 64 of the wedge column 62.

Figure 3:
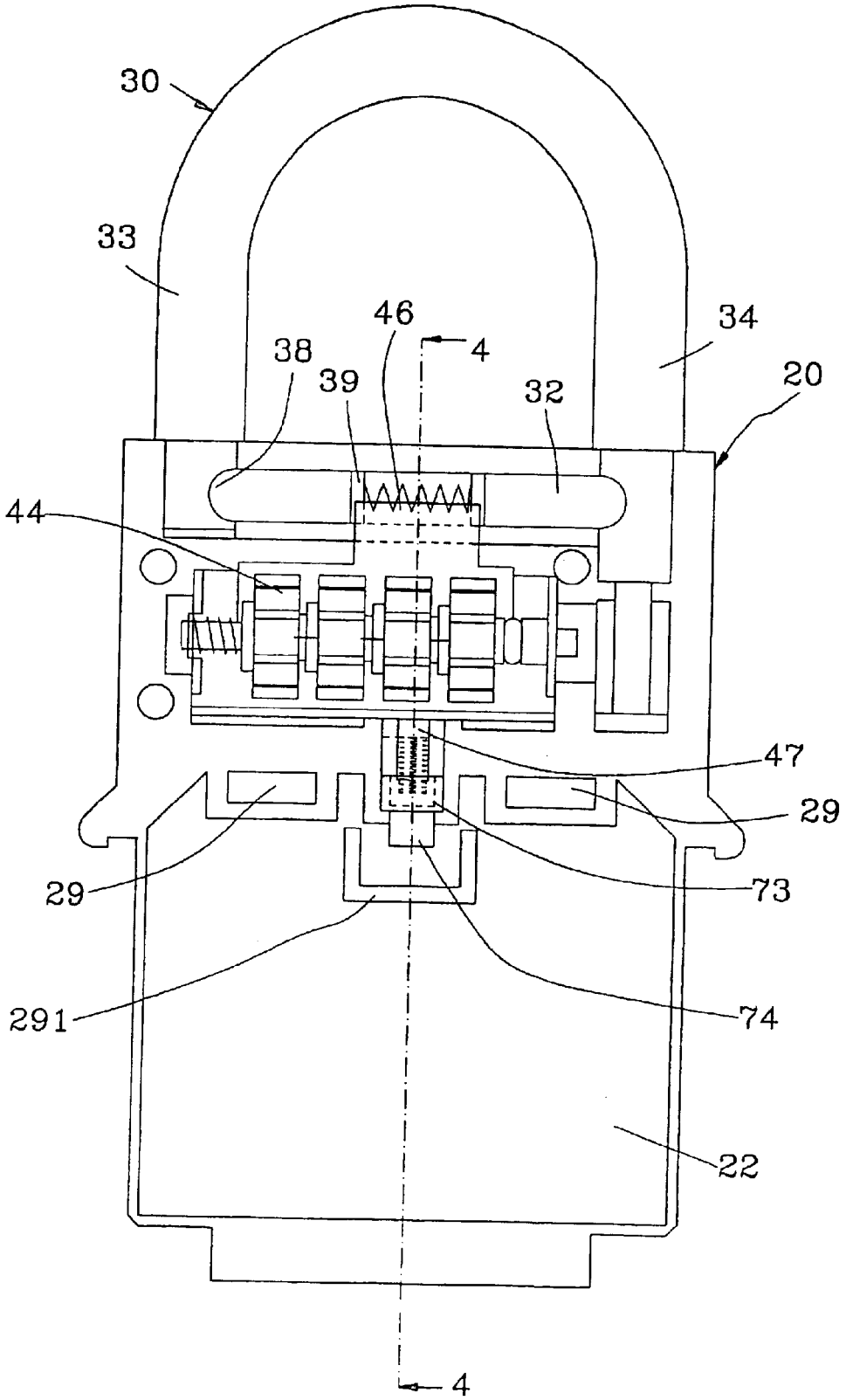
FIG. 3 is a schematic view of the padlock of the present invention, showing the inside of a base housing.
Figure 6:
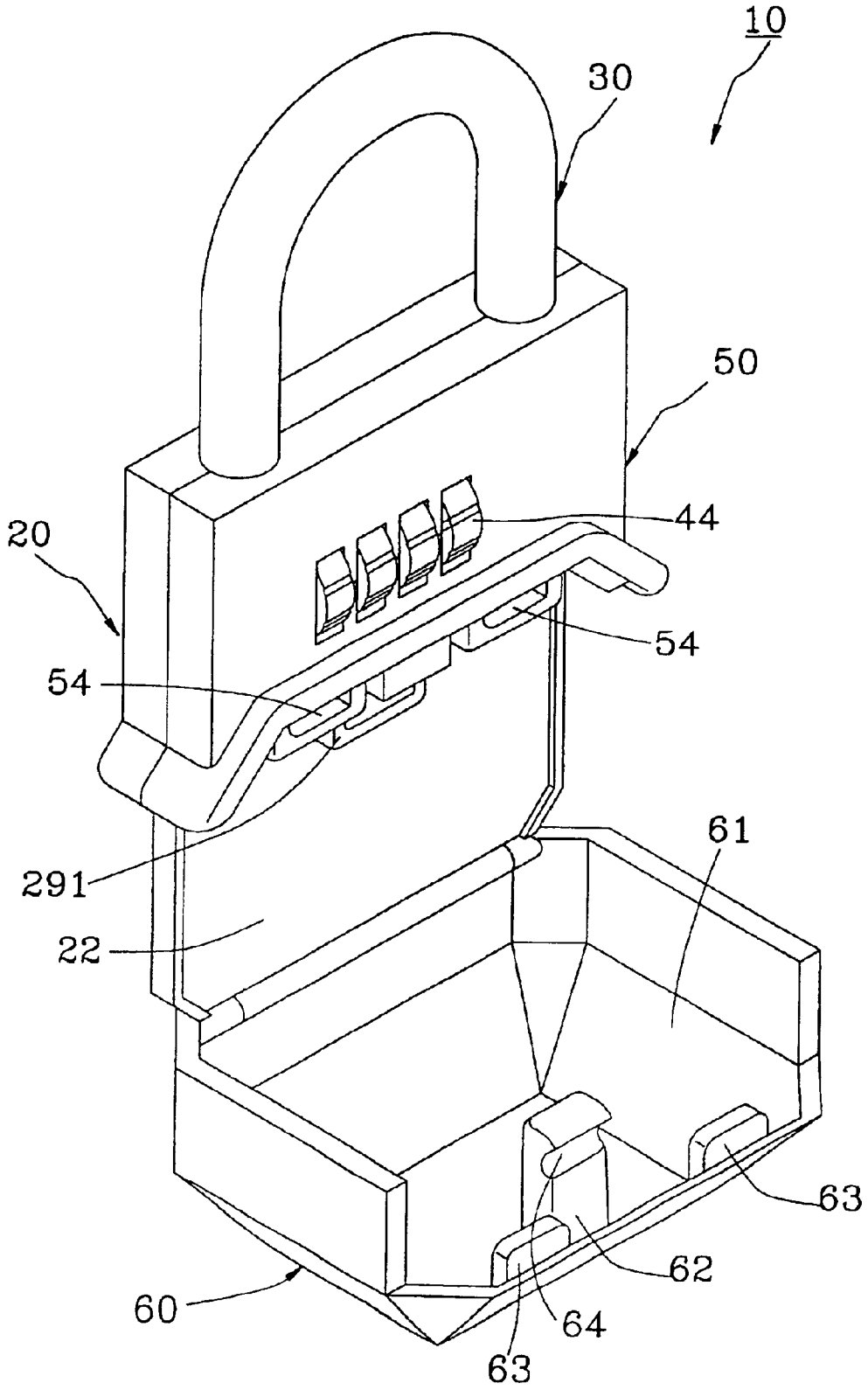
FIG. 6 is a perspective view of the padlock of the present invention, showing that a cover shell is opened.

When the numbered wheel set 40 displays a correct combination, as shown in FIGS. 3 and 4, the fastening pieces 32 is moved to the second position and jams the shackle bar 31 only by the resilience of the spring 37, such that the shackle bar 31 can be easily opened by an external force to traverse. At the same time, the lower fastening portion 47 of the movable fastening sheet 43 corresponds to the cavity 73 of the block 72 and the block 72 is engaged against merely by the spring 71, such that the cover shell 60 can be easily opened by an external force, as shown in FIG. 6.

When the shackle bar 31 and the cover shell 60 are closed, turn the numbered wheels 44 to drive the upper fastening portion 46 of the movable fastening sheet 43 to be jammed between the two stepped portions 39 and to enable the two fastening ends 38 of the two fastening pieces 32 to engage the recessed portions 36 of the shackle bar 31, thereby locking the shackle bar 31 firmly, i.e. the shackle bar 31 is locked and fails to be opened by pulling it upwards. At the same time, the lower fastening portion 47 of the movable fastening sheet 43 is turned conversely about the rotary shaft 41, i.e. the lower fastening portion 47 is not aligned with the cavity 73 of the block 72 but engages against the top side of the block 72 to further enable the lug 74 to be tightly jammed in the concave portion 64, thereby synchronically securely locking the cover shell 60.

Furthermore, when the cover shell 60 is closed and locked, the two positioning blocks 63 are simultaneously inserted into the two through holes 54 and the two positioning holes 29, such that the cover shell 60 can resist a downward hitting force to structurally strengthen the padlock 10, thereby preventing the padlock 10 from damage by an external force. In addition, when the cover shell 60 is closed, the wedge column 62 of the cover shell 60 engages against an upper side of the U-shaped guarding rib 291 at a distal bottom side thereof. Accordingly, the cover shell 60 can also resist a downward hitting force to structurally strengthen the padlock 20 if the two positioning blocks 63 are eliminated or nonfunctional, thereby preventing the padlock 20 from damage by an external force.

Accordingly, when the padlock 10 is installed to the objects, like general cylindrical locks of handles, rails, etc., the user can safely put a duplicate key in the receiving chamber, and can also put other small objects or notepapers in the receiving chamber to notify or leave messages to other users. When the padlock 10 is unlocked, as shown in FIG. 6, the cover shell 60 is unsealed to enable an opening thereof to face upwards and to enable the receiving chamber 61 to be exposed outside, such that it is more convenient to put the objects in and out of the receiving chamber. When the padlock 10 is locked, it is structurally strengthened to be safe.

What is claimed is:

1. A padlock having a receiving chamber for storing things therein, said padlock comprising:

a base housing having a compartment formed inside;

a shackle set mounted on said base housing and having a shackle bar and at least one fastening piece for locking said shackle bar;

a numbered wheel set disposed in said compartment and having a fastening sheet moveable between a first position such that said fastening sheet engages the fastening piece for enabling said fastening piece to firmly lock said shackle bar and a second position such that said fastening sheet disengages the fastening piece for enabling said fastening piece to detachably lock said shackle bar, and a plurality of numbered wheels for driving said fastening sheet to move to one of the first and second positions;

a cover housing mounted on said base housing and over said compartment, said cover housing having a plurality of slots through which said numbered wheels are exposed;

a base shell extending from a side of said base housing;

a concavoconvex cover shell pivotably closeably connected with a bottom lateral edge of the base shell to form the receiving chamber between the cover shell and the base shell; and a locking member mounted in said compartment of said base housing for locking said cover shell;

wherein the locking member locks the cover shell firmly when the fastening sheet is moved to the first position and the locking member locks the cover shell detachably when the fastening sheet is moved to the second position.

2. The padlock as defined in claim 1, wherein said shackle bar comprises a curved hook portion, a straight rod portion, and two recessed portions formed respectively at two opposite inner sides of said rod portion and said hook portion.

3. The padlock as defined in claim 2, wherein said shackle set comprises two of said fastening pieces and a spring disposed between said two fastening pieces for pushing said two fastening pieces to respectively engage said recessed portions of said shackle bar.

4. The padlock as defined in claim 3, wherein said movable fastening sheet of said numbered wheel set comprises an upper fastening portion extending from a side thereof engageable between said two fastening pieces.

5. The padlock as defined in claim 1, wherein said cover shell is pivotably connected with the bottom lateral edge of said base shell at a lateral edge thereof.

6. The padlock as defined in claim 1, wherein said locking member comprises a block for fastening said cover shell and a spring engaging against said block; said cover shell further comprises a wedge column extending from an inner side thereof, said wedge column having a concave portion detachably engaged with said block.

7. The padlock as defined in claim 6, wherein said block of said locking member is convex-shaped.

8. The padlock as defined in claim 6, wherein said movable fastening sheet of said numbered wheel set further comprises a lower fastening portion engageable to said block of said locking member.

9. The padlock as defined in claim 8, wherein said block further comprises a cavity correspondable to said lower fastening portion of said movable fastening sheet.

10. The padlock as defined in claim 6, wherein said base housing further comprises a U-shaped guarding rib for receiving therein said wedge column of the cover shell such that said wedge column of the cover shell engages against said U-shaped guarding rib when the cover shell is closed and receives an external force.

11. The padlock as defined in claim 1, wherein said cover shell further comprises two positioning blocks extending outwards from an inner side thereof; said base housing further comprises two positioning holes corresponding to said two fastening blocks for inserting said two positioning blocks while said cover shell is closed.

* * * * *